United States Patent [19]

Nakamura et al.

[11] Patent Number: 4,752,238

[45] Date of Patent: Jun. 21, 1988

[54] MULTICONDUCTOR FLAT CABLE ELECTRICAL CONNECTOR

[75] Inventors: Mitsuo Nakamura; Keiji Souma, both of Tokyo, Japan

[73] Assignee: Hirose Electric Co., Ltd., Tokyo, Japan

[21] Appl. No.: 82,595

[22] Filed: Aug. 7, 1987

[30] Foreign Application Priority Data

Aug. 8, 1986 [JP] Japan ..... 61-186241

[51] Int. Cl.[4] ..... H01R 4/24

[52] U.S. Cl. ..... 439/399

[58] Field of Search ..... 439/391, 392, 395–399, 439/401–405, 417, 418

[56] References Cited

U.S. PATENT DOCUMENTS

| | | | |
|---|---|---|---|
| 4,195,893 | 4/1980 | Stupay | 339/14 R |
| 4,209,219 | 6/1980 | Proietto | 339/99 R |
| 4,257,028 | 3/1981 | Narozny et al. | 439/399 |
| 4,484,791 | 11/1984 | Johnson | 339/99 R |

*Primary Examiner*—Joseph H. McGlynn

*Attorney, Agent, or Firm*—Yusuke Takeuchi

[57] ABSTRACT

A multiconductor flat cable electrical connector for terminating a plurality of multiconductor flat cables, which comprises a plurality of contacts each having a contacting portion for contact with a contact of the mating connector and a piercing portion for connection with a conductor of said flat cables; an insulating housing for mounting said contacts in such a manner that said piercing portions may project from the top of said insulating housing at least two staggered rows; a cable retainer having first fastener means for joining said cable retainer to the top of said insulating housing, a retention channel on one side, a termination channel on its bottom in communication with said retention channel for retaining the end portions of said flat cables, and a plurality of slots in said termination channel for receiving said piercing portions projecting from the top of said insulating housing; and a cable guide having second fastener means for joining said cable guide to the top of said cable retainer for separating and guiding said flat cables into at least two directions.

8 Claims, 4 Drawing Sheets

MULTICONDUCTOR FLAT CABLE ELECTRICAL CONNECTOR

BACKGROUND OF THE INVENTION

1. Field of the Invention

The present invention relates generally to multiconductor flat cable electrical connectors, especially to a multiconductor flat cable electrical connector for terminating a plurality of multiconductor flat cables.

2. Description of the Prior Art

As electronic equipment is made compact and lightweight, there is a growing demand for high density mounting technology. FIG. 9 shows conventional electrical connectors A through F mounted on a pair of circuit boards 5 with high density. Taking the connector A for example, three multiconductor flat cables 1, 2, and 3 are connected thereto. The cable 1 is bent almost 90 degrees above the connector A and connected to the connector B. In its middle, it is provided with a dip 1A so as to ease the plug-in or out of the connector A or B. Similarly to the cable 1, the cable 2 is connected to the connector C. The cable 3, extending upward, is connected to the connector D. The other connectors B, C, and D are provided with cables in the same way as the connector A.

The aforementioned multiconductor flat cable electrical connector has the following shortcomings.

(1) Since cables are bent almost 90 degrees on the top of a connector, conductors of the cables can be broken due to the bending load applied upon plugging in or out of the connector.

(2) Each cable needs a dip, increasing the unit cost by that much.

(3) The dips of respective cables interfere or collide with each other or other components, presenting the possibility of damage to the cable or other component or producing an adverse electrical effect.

(4) The cables bent to opposite sides on the top of a connector makes the plug-in or out of the connector so difficult that an excess load can be applied on the cable, having an adverse effect on the connector.

(5) The distance between the circuit boards 5 must be sufficiently large to accomodate the dips, thus limitting the miniaturization of the electronic equipment.

SUMMARY OF THE INVENTION

Accordingly, it is an object of the invention to provide a multiconductor flat cable electrical connector improved with respect to the aforementioned problems.

In accordance with the invention there is provided a multiconductor flat cable electrical connector for terminating a plurality of multiconductor flat cables, which comprises a plurality of contacts each having a contacting portion for contact with a contact of the mating connector and a piercing portion for connection with a conductor of said flat cables; an insulating housing for mounting said contacts in such a manner that said piercing portions may project from the top of said insulating housing at least two staggered rows; a cable retainer having first fastener means for joining said cable retainer to the top of said insulating housing, a retention channel on one side, a termination channel on its bottom in communication with said retention channel for retaining the end portions of said flat cables, and a plurality of slots in said termination channel for receiving said piercing portions projecting from the top of said insulating housing; and a cable guide having second fastener means for joining said cable guide to the top of said cable retainer for separating and guiding said flat cables into at least two directions.

Other objects, features, and advantages of the invention will be apparent from the following description taken in conjunction with the accompanying drawings.

DESCRIPTION OF THE PREFERRED EMBODIMENTS

Figure 1:
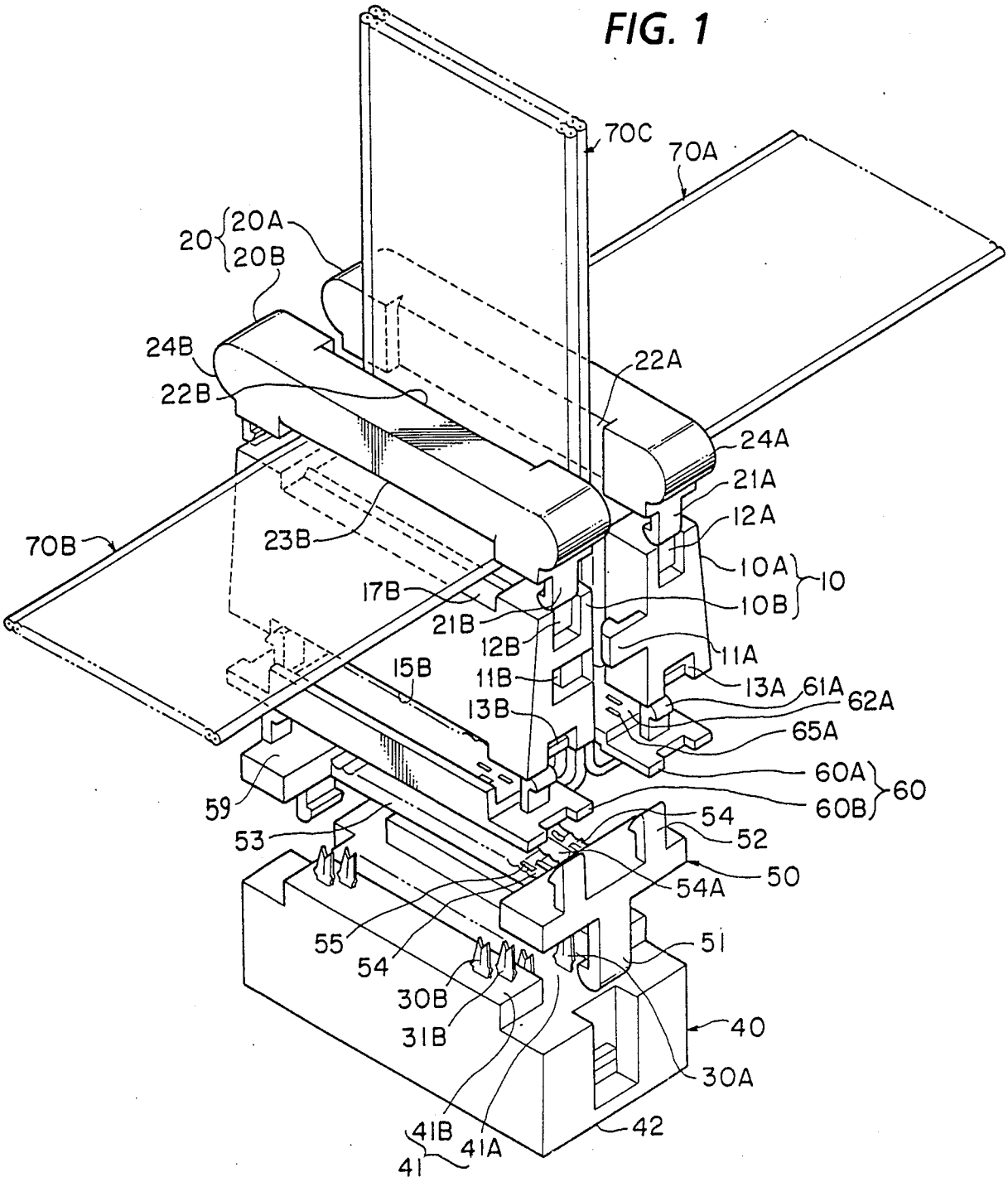
FIG. 1 is an exploded perspective view of a multiconductor flat cable electrical connector embodying the present invention.

Referring now to FIG. 1 there is shown an exploded view of a multiconductor flat cable electrical connector which consists of a cable retainer 10 for retaining a plurality of multiconductor flat cables 70, a cable guide 20 placed on top of the cable retainer 10 for guiding the cables to three directions, a plurality of contacts 30 having a contacting portion for contact with a contact of the mating connector and a piercing portion 31 for connction with a conductor of the flat cable, an insulating housing 40 for mounting these contacts in such a manner that the piercing portions 31 may project from the top of the housing 40, a first termination member 50 placed on top of the insulating housing 40 for terminating an inner pair of flat cables 70C, and a second terminating member 60 placed on top of the first termination member 50 for terminating an outer pair of flat cables 70A and 70B.

Figure 2:
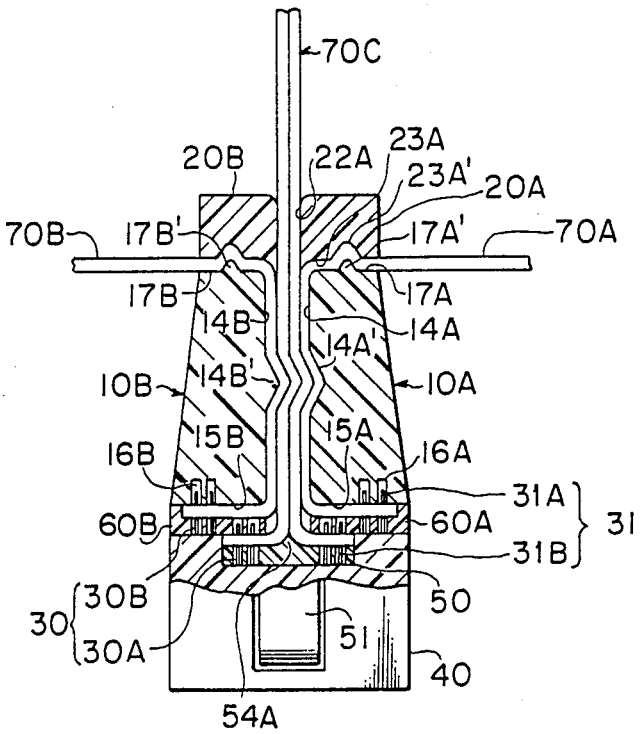
FIG. 2 is a sectional view of the electrical connector of FIG. 1 to which a plurality of cables are terminated.

FIG. 2 shows a section of the FIG. 1 connector with the respective flat cables connected thereto. The cable retainer 10 consists of a pair of right and left retainer sections 10A and 10B which are adapted to join together. As best shown in FIG. 1, the right retainer section 10A has a forward latch arm 11A for engagement with a latch recess 11B of the left retainer section 10B for uniting these two sections. It also has at its upper edge a latch recess 12A for engagement with a downward latch arm 21A of the right cable guide 20A and at its lower edge a latch recess 13A for engagement with an upward latch arm 52 of the first termination member 50. Further, it has at its bottom a latch slot (not shown) for engagement with an upward latch arm 61A of the right termination section 60A.

As best shown in FIG. 2, the right and left retainer sections 10A and 10B have retention channels 14A and 14B, respectively, to retain the flat cables between them. They also have a V-shaped groove 14A' and a V-shaped ridge 14B', respectively, in the middle of the channels to prevent pull-off of the multiconductor flat cables. The right retainer section has at its bottom a termination channel 15A in communication with the retention channel 14A and two staggered rows of recesses 16A for receiving the piercing portions 31A of the contacts 31. It also has at its top a retention channel 17A for retaining the flat cable 70A horizontally to the right side and a ridge 17A' to prevent pull-off of the flat cable 70A.

The structure of the left retainer section 10B is similar to that of the right retainer section 10A and, therefore, its detailed description will be omitted.

As best shown in FIG. 1, the cable guide 20 consists of right and left guide sections 20A and 20B. The right guide section 20A has a pair of downward latch arms 21A for engagement with latch recesses 12A of the right retainer section 10A. It has on one side a retention channel 22A for retaining the vertical flat cables 70C and on its bottom a retention channel 23A for cooperation with the right retainer section 10A to retain the horizontal flat cable 70A. As best shown in FIG. 2, the right guide section has a groove 23A' in the middle of the retention channel 23A to prevent pull-off of the flat cable 70A. It also has a pair of semicylindrical portions 24A to facilitate plug-in or out of the connector.

The structure of the left guide section 20B is similar to that of the right guide section 20A and, therefore, its detailed description will be omitted.

The contacts 30 mounted in the insulating housing 40 are made of spring conductive metal so as to have a contacting portion (not shown) and a piercing portion 31. There are two types of contacts; short ones 30A mounted in an inner pair of two staggered rows and tall ones 30B mounted in an outer pair of two staggered rows.

The insulting housing 40 is made of a plastic or other insulating material so as to have a top 41 and a bottom or mating face 42. The top 41 has a first surface 41B and a pair of second surfaces 41B elevated from the first surface 41A. A pair of two staggered rows of piercing portions 31A of short contacts 30A project from the first surface 41A while a pair of two staggered rows of piercing portions 31B of tall contacts 30B project from the sectond surfaces 41B.

The first termination member 50 is made of a plastic or other insulating material so as to have a pair of downward latch arms 51 and two pairs of upward latch arms 52 on opposite extended sides 59. Between these extended sides there is provided a termination support 53 with termination grooves 54 extending parallel to the extended sides for receiving the respective conductors of the flat cables 70C bent at right angles to opposite sides. Along the center line of the termination support 53 there is provided a ridge 54 to help separation of the pair of flat cables 70 to opposite sides. The termination support 53 has two pairs of two staggered rows of slots 55 for receiving the piercing portions 31A projecting from the first top surface 41A.

The second termination member 60 consists of a pair of termination sections 60A and 60B corresponding to the respective retainer sections 10A and 10B. The right termination section 60A has on opposite sides a pair of upward latch arms 61A, between which there is provided a termination support 62A with two pairs of two staggered rows of slots 65A through which the piercing portions 31A and 31B are passed. It is preferred that the termination support 62A is made so as to fit into the termination channel 15A provided on the bottom of the right retainer section 10A.

The structure of the left termination section 60B is similar to that of the right termination section 60A and, therefore, its description will be omitted.

A procedure of terminating a plurality of flat cables to such an electrical connector will be described.

(1) Fist of all, the end portions of the flat cable 70A placed on the right retainer section 10A by bending it into a U-shaped form as shown in FIG. 2. The right guide section 20A and the right termination section 60A are attached on top and bottom of the retainer section 10A, respectively, to retain the cable end portion. Similarly, the end portion of the flat cable 70B is attached to the left retainer section 10B. Of course, the flat cable 70B may be attached to the retainer section 10B before the flat cable 70A is attached to the retainer section 10A.

(2) Then, a pair of flat cables 70C are placed between the right and left retainer sections 10A and 10B and both the retainer sections are joined together to retain all the flat cables 70A, 70B, and 70C, with the respective end portions of the two flat cables 70C bent to opposite sides along the bottoms of the right and left termination sections 60A and 60B, respectively. The first termination member 50 is then attached to the bottom of the cable retainer 10.

(3) The cable retainer 10 with the flat cables 70A, 70B, and 70C attached is then secured to the top of the insulating housing 40 so that the respective piercing portions 31 projecting from the insulating housing 40 may pierce the insulation and contact the respective conductors of these flat cables.

Figure 3:
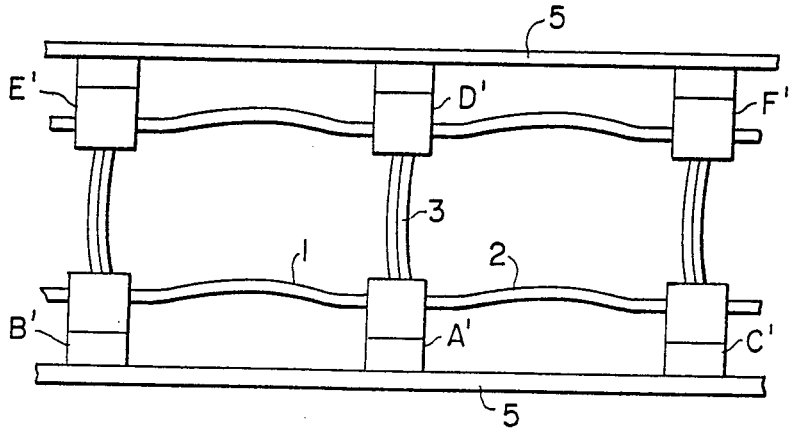
FIG. 3 illustrates the high density mounting of electrical connectors of FIG. 1.
Figure 9:
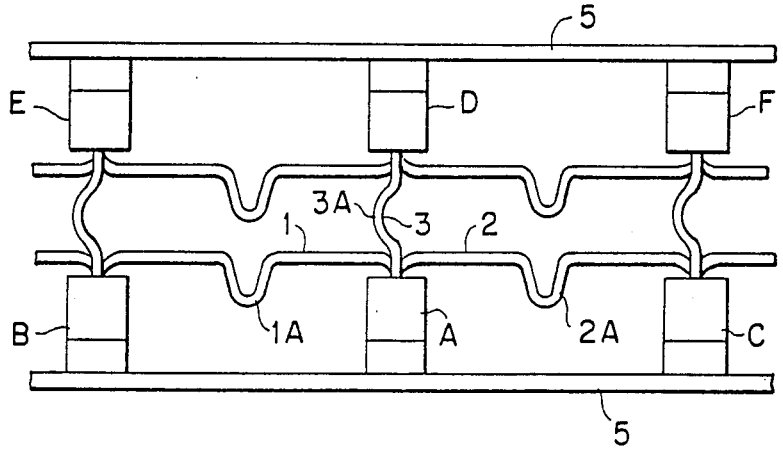
FIG. 9 PRIOR ART
FIG. 9 shows the high density mounting of conventional electrical connectors.

FIG. 3 shows thus terminated electrical connectors A', B', C', D', E', and F' mounted on a pair of circuit boards 5 with high density. The cables 1 and 2 extend from the sides of connector A' to the connectors B' and C' on opposite sides so that it is unnecessary to provide any dip such as shown in FIG. 9. If the flat cables are not required to extend in all the three directions, a short length of dummy cable may be placed between the retainer sections in the absent direction.

Figure 4:
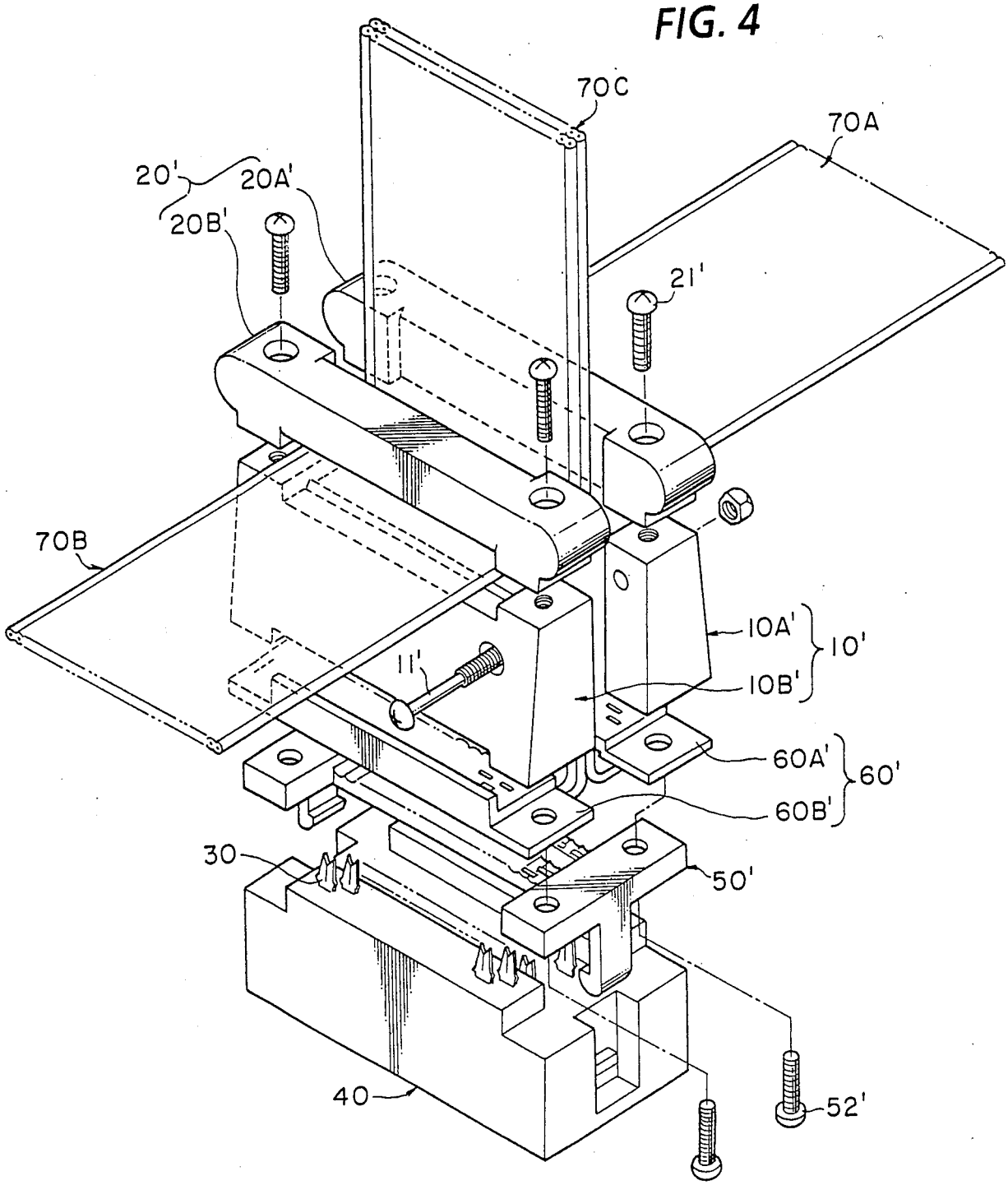
FIGS. 4 through 8 are sectional views of various electrical connectors embodying the present invention.

FIG. 4 shows an exploded view of another electrical connector embodying the present invention. Similarly to the FIG. 1 electrical connector, this electrical connector has right and left retainer sections 10A' and 10B', right and left guide sections 20A' and 20B', an insulating housing 40 with contacts mounted thereon, a first termination member 50', and a second termination member 60' consisting of right and left termination sections 60A' and 60B'. These components are the same as those of FIG. 1 except for the following points. In the FIG. 1 electrical connector, the latch-recess fastener means are used to join the right and left retainer sections, the cable retainer and cable guide, and the retainer sections and first and second termination sections, but in this embodiment, screws 11', 21', and 52' are used to join the respective components. With the use of these screws, this electrical connector may be used for various flat cables with different thicknesses in contrast to the FIG. 1 electrical connector which is used for only the fixed thickness flat cables.

Figure 5:
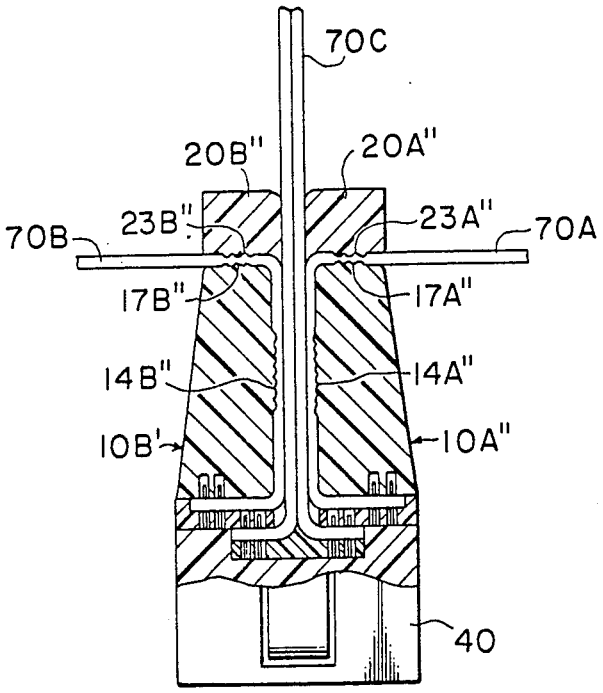

FIG. 5 shows still another electrical connector embodying the present invention. In this embodiment, three pairs of corrugated sections 14A" and 14B", 17A" and 23A", and 17B" and 23B" are provided in the retainer sections 10A" and 10B" and guide sections 20A" and 20B" in place of the aforementioned groove-ridge means to prevent pull-off of the flat cables. With this structure, the right and left components may be made identical, thus reducing the unit manufacturing cost.

Figure 6:
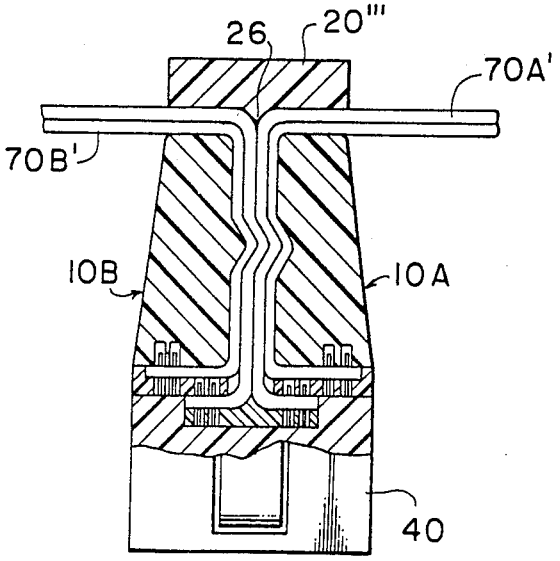

FIG. 6 shows yet another electrical connector embodying the present invention. In this embodiment, the cable guide is composed of a single piece 20''' with a ridge 26 provided along its center line to help separation and horizontal extension of two pairs of the flat cables 70A' and 70B', one pair for each side. The other components are the same as those of FIG. 1 and, therefore, their description will be omitted.

Figure 7:
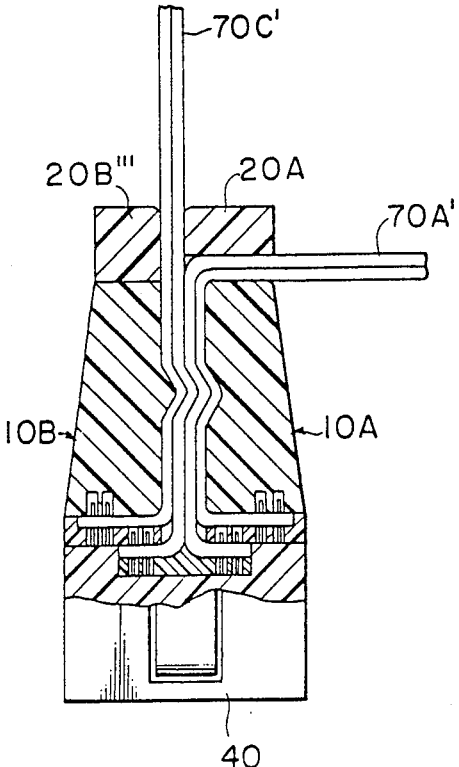

FIG. 7 shows another electrical connector embodying the present invention. In this embodiment, the cable guide is composed of a right guide section 20A and a left guide section 20B''' to direct a pair of flat cables 70A' in the horizontal direction and another pair of flat cables 70C' in the vertical direction. The other components are the same as those of FIG. 1 and their description will be omitted.

Figure 8:
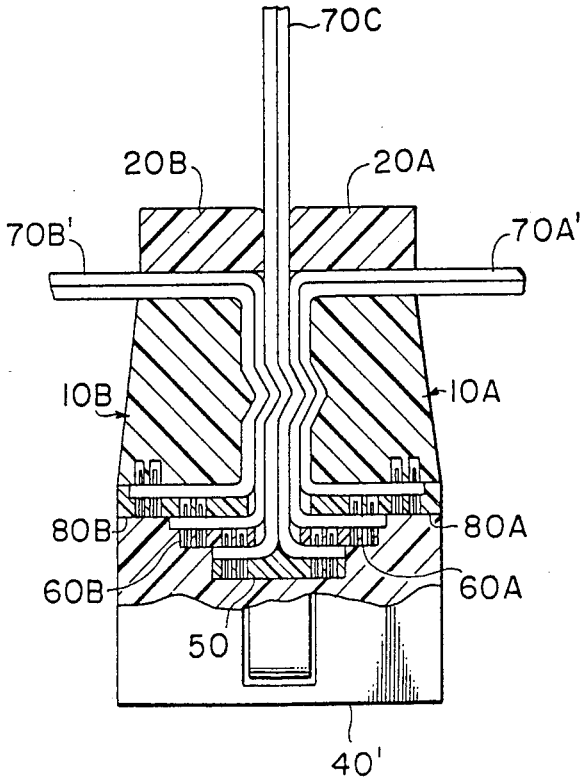

FIG. 8 shows a still another electrical connector embodying the present invention. In this embodiment, two pairs of flat cables 70A' and 70B', and a pair of flat cables 70C extend from the connector in the horizontal and vertical directions, respectively. The six-layered flat cables are terminated in three levels on either side with the aid of the first termination member 50, and two pairs of second and third termination sections 60A and 60B, and 80A and 80B. The other components are the same as those of FIG. 1, and their description will be omitted.

According to the invention there are provided the following advantages.

(1) The cables extending to the horizontal direction do not suffer from any excess bending load, thus eliminating the possibility that conductors of the cables are broken due to the excess bending load.

(2) These electrical connectors may be mounted with high density without the provision of a dip so that the respective cables do not interfere with each other or other electronc components, thus eliminating any troubles otherwise produced by such contact.

(3) Since each cable may be stretched across the respective connectors without substantial sagging, the length of the cable is saved by that much, reducing the unit manufacturing cost.

(4) Since the flat cables are not bent at the top of the cable retainer but extended from between the cable guide and the retainer, these cables do not hinder the plug-in or out operation, thus eliminating the possibility of excess forces applied to the cables by accident.

While a preferred embodiment of the invention has been described using specific terms, such description is for illustrative purpose only, and it is to be understood that changes and variations may be made without departing from the spirit and scope of the invention as recited in the following claims.

What is claimed is;

1. A multiconductor flat cable electrical connector for terminating a plurality of multiconductor flat cables, which comprises:

a plurality of contacts each having a contacting portion for contact with a contact of the mating connector and a piercing portion for connection with a conductor of said flat cables;

an insulating housing for mounting said contacts in such a manner that said piercing portions may project from the top of said insulating housing at least two staggered rows;

a cable retainer having first fastener means for joining said cable retainer to the top of said insulating housing, a retention channel on one side, a termination channel on its bottom in communication with said retention channel for retaining the end portions of said flat cables, and a plurality of slots in said termination channel for receiving said piercing portions projecting from the top of said insulating housing; and a cable guide having second fastener means for joining said cable guide to the top of said cable retainer for separating and guiding said flat cables into at least two directions.

2. A multiconductor flat cable electrical connector according to claim 1, wherein said cable retainer consists of a pair of sections with said retention channel between them.

3. A multiconductor flat cable electrical connector according to claim 2, wherein said first and second fastener means consist of a latch arm and a latch recess.

4. A multiconductor flat cable electrical connector according to claim 2, wherein said first and second fastener means consist of a bolt and a nut.

5. A multiconductor flat cable electrical connector according to claim 1, which further comprises at least two termination members adapted to be joined to the bottom of said cable retainer for retaining said end portions in said termination channels in at least two levels.

6. A multiconductor flat cable electrical connector according to claim 1, wherein said cable guide separates said multiconductor flat cables into three groups and guides them in three directions; a first group in a first direction parallel to said retention channel, a second group in a second direction perpendicular to said retention channel, and a third group in a third direction perpendicular to said retention channel and opposite to said second direction.

7. A multiconductor flat cable electrical connector according to claim 1, wherein said cable guide separates said multiconductor flat cables into two groups and guides them in two directions; a first group in a first direction perpendicular to said retention channel and a second group in a second direction perpendicular to said retention channel and opposite to said first direction.

8. A multiconductor flat cable electrical connector according to claim 1, wherein said cable guide separates said multiconductor flat cables into two groups and guides them in two directions; a first group in a first direction parallel to said retention channel and a second group in a second direction perpendicular to said retention channel.

* * * * *